US011647347B2

(12) United States Patent
Goodland et al.

(10) Patent No.: US 11,647,347 B2
(45) Date of Patent: May 9, 2023

(54) METHOD OF MANUFACTURING A FACEPLATE FOR A HEARING DEVICE

(71) Applicant: Sonova AG, Stafa (CH)

(72) Inventors: Daniel R. Goodland, Milton (CA); Andre L. Ochsenbein, Wolfhausen (CH)

(73) Assignee: SONOVA AG, Stäfa (CH)

( * ) Notice: Subject to any disclaimer, the term of this patent is extended or adjusted under 35 U.S.C. 154(b) by 242 days.

(21) Appl. No.: 16/989,989

(22) Filed: Aug. 11, 2020

(65) Prior Publication Data

US 2021/0051428 A1 Feb. 18, 2021

(30) Foreign Application Priority Data

Aug. 16, 2019 (EP) ..... 19192094

(51) Int. Cl.
*H04R 25/00* (2006.01)
*H01Q 1/27* (2006.01)
*H01Q 9/16* (2006.01)

(52) U.S. Cl.
CPC ..... *H04R 25/658* (2013.01); *H01Q 1/273* (2013.01); *H01Q 9/16* (2013.01); *H04R 25/554* (2013.01); *H04R 25/602* (2013.01); *H04R 25/609* (2019.05); *H04R 2225/025* (2013.01); *H04R 2225/51* (2013.01)

(58) Field of Classification Search
CPC ..... H04R 25/60; H04R 25/609; H04R 25/65; H04R 25/658; H04R 2225/025; H04R 2225/51
USPC ..... 381/322, 323, 324, 328
See application file for complete search history.

(56) References Cited

U.S. PATENT DOCUMENTS 8,494,197 B2 7/2013 Polinske et al.
9,154,864 B1 * 10/2015 Sell ..... H04R 1/02
2003/0044037 A1 * 3/2003 Park ..... H04R 25/609 381/328

(Continued)

FOREIGN PATENT DOCUMENTS

EP 2200119 A2 6/2010
EP 2200348 A1 6/2010

(Continued)

OTHER PUBLICATIONS

Search Report issued in European Patent Application No. 19192094.1 dated Jan. 24, 2020.

*Primary Examiner* — Katherine A Faley
(74) *Attorney, Agent, or Firm* — Pearne & Gordon LLP

(57) ABSTRACT

A method of manufacturing a faceplate for a hearing device, the faceplate configured to cover a lateral opening of a housing of the hearing device and having a side which is laterally oriented when the hearing device is worn at least partially in the ear canal, including the steps of: providing a faceplate base part including a first surface, a faceplate insertion part including a second surface, and a printed circuit board ("PCB") with an antenna; inserting the antenna PCB into the faceplate base part so that that the antenna PCB extends along the first surface; inserting the faceplate insertion part into the faceplate base part so that the second surface of the faceplate insertion part pushes the antenna PCB against the first surface of the faceplate base part; and fixing the faceplate insertion part within the faceplate base part so as to form the faceplate.

20 Claims, 5 Drawing Sheets

(56) References Cited

U.S. PATENT DOCUMENTS

| | | | | |
|---|---|---|---|---|
| 2003/0123687 | A1 | 7/2003 | Petrick et al. | |
| 2010/0158295 | A1* | 6/2010 | Polinske ..... | H01Q 1/243 343/866 |
| 2017/0134870 | A1 | 5/2017 | Helgeson et al. | |
| 2017/0150278 | A1 | 5/2017 | Ruaro | |

FOREIGN PATENT DOCUMENTS

| | | | |
|---|---|---|---|
| EP | 2680613 | A2 | 1/2014 |
| EP | 2688314 | A2 | 1/2014 |
| EP | 3110174 | A1 | 12/2016 |
| WO | 20170153020 | A1 | 9/2017 |

* cited by examiner

METHOD OF MANUFACTURING A FACEPLATE FOR A HEARING DEVICE

The invention relates to a method of manufacturing a faceplate for a hearing device comprising an antenna.

BACKGROUND

Hearing devices which are to be worn at least partially in the ear canal comprise a housing or shell with an outwardly facing opening which is covered by a faceplate. ITE ("in-the-ear") hearing devices are examples of such hearing devices. For wireless applications, the hearing devices may comprise an antenna which can be integrated within the faceplate.

US 2017/0150278 A1 relates to an ITE hearing aid wherein a magnetic loop antenna is integrated within the faceplate.

EP 3 110 174 A1 relates to an ITE hearing aid comprising a faceplate in which an antenna is embedded or in-molded. The antenna may be designed as a loop antenna and it may include a flexible printed circuit board ("PCB").

WO 2017/0153020 A1 relates to an ITE hearing aid comprising an annular antenna which is arranged on the faceplate or parallel to the faceplate.

U.S. Pat. No. 8,494,197 B2 relates to an ITE hearing aid with a loop antenna on a flexible PCB which loops around the battery; the PCB is inserted into a trench provided at the interior side of the faceplate in such a manner that the PCB is oriented perpendicular to the faceplate.

BRIEF SUMMARY

It is an object of the invention to provide an efficient and accurate method of manufacturing a faceplate for a hearing device which is to be worn at least partially in the ear canal, wherein an antenna is integrated within the faceplate.

According to the invention, this object is achieved by methods as defined in the claims.

The invention is beneficial in that it allows for an accurate and consistent placement of the antenna within the hearing device; in addition, assembly efficiency and serviceability may be improved; in particular, assembly time may be reduced, accuracy of assembly may be increased, serviceability may be improved, as well as reliability of antenna performance.

Preferred embodiments of the invention are defined in the dependent claims.

Preferred embodiments of one method may include at least one the following aspects:

The faceplate insertion part may comprise engagement structures for holding down the antenna PCB towards the faceplate base part, wherein the engagement structures of the faceplate insertion part may comprise a plurality of tabs which extend towards the exterior of the hearing device in a direction perpendicular to second surface and which are circumferentially spaced apart.

The first surface of the faceplate base part and the second surface of the faceplate insertion part may be inclined in parallel directions so that the second surface of the faceplate insertion part presses the antenna PCB snugly towards the first surface of faceplate base part.

The faceplate base part and the faceplate insertion part may comprise mating features so as to align the faceplate base part and the faceplate insertion part relative to each other.

An adhesive may be applied to at least part of the mating features so as to fix the faceplate insertion part to the faceplate base part.

An adhesive may be applied to the antenna PCB so as to fix the antenna PCB between the second surface of the faceplate insertion part and the first surface of the faceplate base part.

The first surface and the second surface may be complementary.

The first surface may extend along at least part of the circumference of the faceplate base part, and the second surface may extend along at least part of the circumference of the faceplate insertion part.

The first surface of the faceplate base part may face the interior of the hearing device and the second surface of the faceplate insertion part may face the exterior of the hearing device, so as to form a trench for receiving the antenna PCB; he first surface and the second surface may be substantially orthogonal to the laterally oriented side of the faceplate.

The faceplate base part may comprise the laterally oriented side of the faceplate and may be located laterally with regard to the faceplate insertion part.

The faceplate insertion part may be fixed to the faceplate base part by an adhesive.

Preferred embodiments of another method may include at least one of the following aspects:

The plastic frame may extend along more than half of the length of the antenna PCB; in particular, the plastic frame may extend along the entire length of the flexible antenna PCB.

The contour of the plastic frame may substantially equal the contour of the antenna PCB.

The antenna PCB may be first inserted into the trench, and then the plastic frame may be inserted into the trench.

The antenna PCB and the plastic frame may be fixed by an adhesive within the trench.

The antenna PCB may be first fixed by the adhesive to the first surface, and then the plastic frame may be fixed to the antenna PCB and the second surface.

The antenna PCB may be first fixed to the plastic frame, and then the plastic frame, together with the antenna PCB, may be inserted into the trench.

The plastic frame, together with the antenna PCB fixed to the plastic frame, may be fixed within the trench by an adhesive.

The antenna PCB may be wrapped around the plastic frame for fixing the antenna PCB to the plastic frame.

The antenna PCB and the plastic frame may comprise alignment features for aligning the antenna PCB to the plastic frame; the alignment features of the plastic frame may be configured to fix the antenna PCB to the plastic frame.

The antenna PCB may be fixed to the plastic frame by an adhesive.

Alternatively, the plastic frame may extend along less than half of the length of the antenna PCB.

The plastic frame may comprise engagement structures configured to engage with mating engagement structures of the antenna PCB to hold down and locate the antenna PCB within the trench.

The engagement structures of the plastic frame may comprise tabs.

The antenna PCB may be first inserted into the trench, and then the plastic frame may be inserted into the trench.

The antenna PCB and the plastic frame may be fixed by an adhesive within the trench.

The antenna PCB may be first fixed by the adhesive to the first surface, and then the plastic frame may be fixed by the adhesive to the antenna PCB and the second surface.

The first surface of the faceplate base part may face the interior of the hearing device, and the second surface of the faceplate base part may face the exterior of the hearing device, wherein the first surface and the second surface may be substantially orthogonal to the laterally oriented side of the faceplate.

Preferred embodiments of both methods may include at least one the following aspects:

The antenna PCB may be flexible.

The antenna may be integrated within the faceplate in a manner so as to follow the contour of the laterally oriented side of the faceplate to maximize radiation gain, wherein the antenna may comprise a conductor trace located at the lateral edge of the antenna PCB.

The antenna PCB may be oriented orthogonal to the laterally oriented side of the faceplate.

The antenna PCB may be folded around a battery and an electronics subassembly of the hearing device.

The antenna may be a dipole antenna, which preferably has two arms with an end gap between the ends of the arms.

A medial edge of the antenna PCB may be flush with a medially oriented side of the faceplate once the antenna PCB is fixed within the trench.

BRIEF DESCRIPTION OF THE DRAWINGS

Hereinafter, examples of the invention will be illustrated by reference to the attached drawings, wherein.

DETAILED DESCRIPTION

Figures 1A, 1B, 1C:
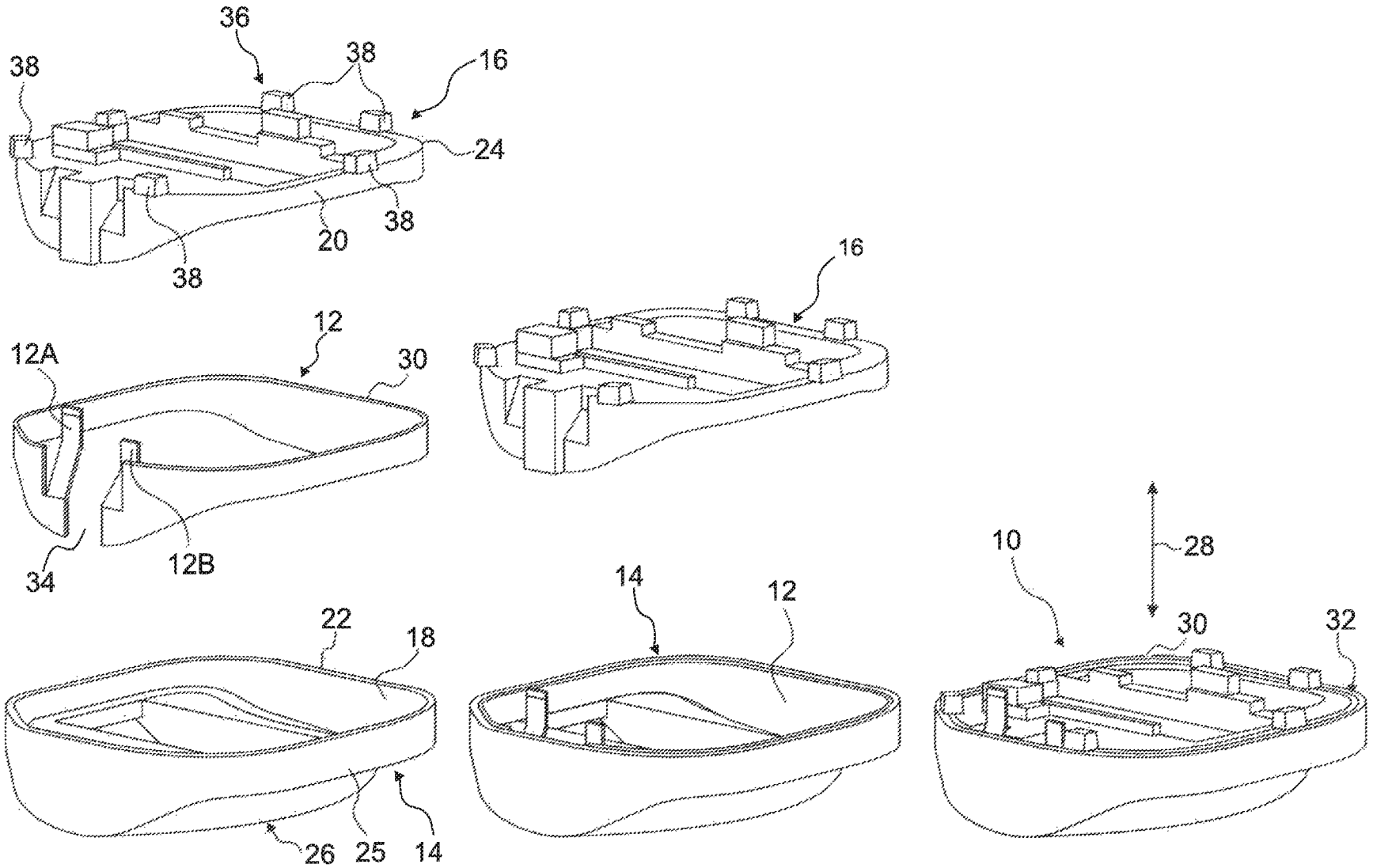
FIGS. 1A to 1C are perspective views of a first example of a faceplate with an antenna, wherein an initial stage, an intermediate stage and a final stage, respectively, of an assembly process are shown.

As used hereinafter, "hearing devices" includes all kinds of hearing devices which are configured to be worn at least partially in the ear canal, such as ITE (In The Ear) hearing devices, ITC hearing devices (in-the canal) or CIC (completely-in-the-canal) hearing devices.

As used hereinafter, "lateral" relates to a direction away from the tympanic membrane, when the hearing device is worn at least partially in the ear canal, and "medial" relates to a direction towards the tympanic membrane, when the hearing device is worn at least partially in the ear canal.

As used hereinafter, "outwardly" relates to a direction perpendicular to the lateral-medial direction and away from the center of the faceplate, and "inwardly" relates to a direction perpendicular to the lateral-medial direction and towards the center of the faceplate.

As used hereinafter, "substantially orthogonal" relates to an angular range from 75 to 105 degrees, and "substantially parallel" relates to an angular range from −15 to +15 degrees.

The invention relates to the manufacturing of faceplates for hearing devices which are to be worn at least partially in the ear canal, wherein the faceplate is configured to cover a lateral opening of the housing of the hearing device, with the faceplate having one side which is laterally oriented when the hearing device is worn at least partially in the ear canal. The housing may be a standard shell (which is not individually shaped) or a customized shell (which is shaped according to the individual shape of the user's ear canal).

An antenna is provided on a PCB, which may be flexible, and is integrated within the faceplate. In some implementations, the antenna is designed for operation in the 2.4 to 2.5 GHz ISM (Industrial, Scientific, and Medical) band. In some implementations, the antenna is a dipole antenna. In some implementations, the antenna is folded around a battery and an electronic sub-assembly of the hearing device.

In some implementations, the antenna is integrated within the faceplate in a manner so as to follow the contour of the laterally oriented side of the faceplate so as to maximize radiation gain.

In some implementations, the antenna PCB is oriented substantially orthogonal to the laterally oriented side of the faceplate.

According to a first aspect of the invention, the faceplate is made of two initially separate parts, namely a faceplate base part and a faceplate insertion part, wherein the two parts, once assembled, together form a trench for the antenna. The antenna is first inserted into the faceplate base part so that the antenna PCB extends along a first (typically inner) surface. Then the faceplate insertion part is inserted into the faceplate base part so that a second (typically outer) surface of the faceplate insertion part pushes the PCB against the (inner) surface of the faceplate base part, with the two surfaces then defining a trench for the PCB. The faceplate insertion part is fixed within the faceplate base part so as to form the faceplate.

FIGS. 1A-C and 2A-C relate to two different examples of this first aspect, wherein an antenna PCB 12 is integrated within a faceplate 10, wherein the faceplate 10 is made of two initially separate parts, namely a faceplate base part 14 and a faceplate insertion part 16, wherein the two parts 14 and 16 cooperate to form a trench in which the antenna PCB 12 is fixed (while in FIGS. 1A-C and 2A-C only the PCB 12 is shown, the electrical conductors actually forming the antenna on the PCB 12 are not shown).

The faceplate base part 14 comprises an inwardly facing first surface 18 (hereinafter "inner surface 18"), and the faceplate insertion part 16 comprises an outwardly facing second surface 20 (hereinafter "outer surface 20") which may be complementary with the first surface 18. The inner surface 18 extends along at least part of the circumference 22 of the faceplate base part 14 (and is located close to a peripheral surface 25 of the faceplate base part 14, and the outer surface 20 preferably extends along at least part of the circumference 24 of the faceplate insertion part 16.

In the examples shown in FIGS. 1A-C and 2A-C, the inner surface 18 extends along almost the entire circumference 22 of the faceplate base plate 14, and the outer surface 20 extends along almost the entire circumference 24 of the faceplate insertion part 16.

The faceplate base part 14 comprises a laterally oriented side 26 of the faceplate 10 and is located laterally with regard to the faceplate insertion part 16 when the hearing device is worn at least partially in the ear canal. The medial-axial direction is indicated in the Figures by an arrow 28; this direction also corresponds to the longitudinal direction of the hearing device.

The inner surface 18 and the outer surface 20 are oriented substantially parallel to the medial-lateral direction 28 and thus are substantially orthogonal to the laterally oriented side 26 of the faceplate 10.

Figures 2A, 2B, 2C:
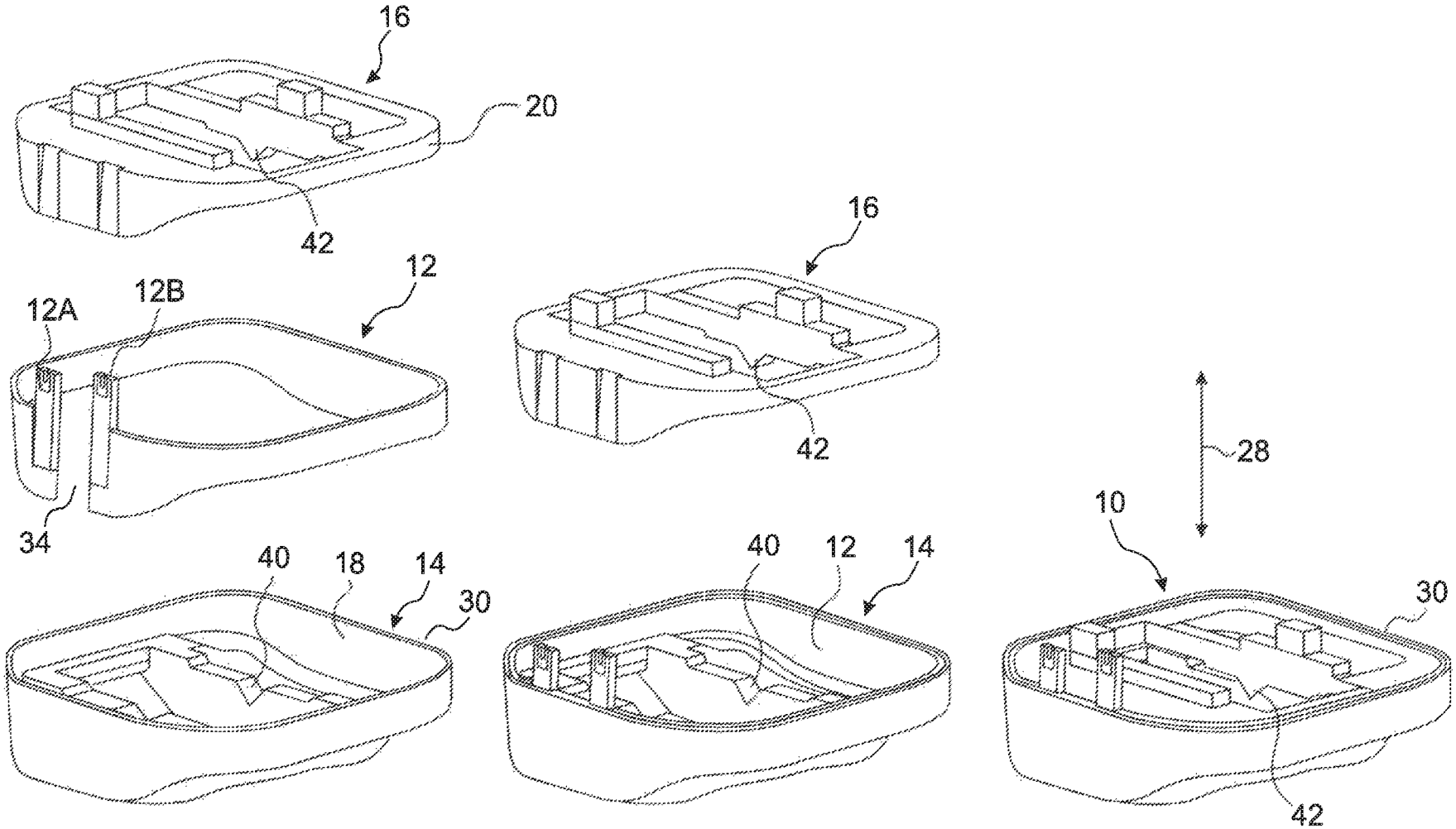
FIGS. 2A to 2C are views similar to FIGS. 1A to 1C, wherein a second example is shown.

In some implementations, a medial edge 30 of the antenna PCB 12 is flush with a medially oriented side 32 of the faceplate 10 after assembly (see FIGS. 1C and 2C).

In the examples shown in FIGS. 1A-C and 2A-C; the outer surface 20 of the faceplate insertion part 16 forms a peripheral surface of the faceplate insertion part 16 (in other words, it forms the outer boundary of the faceplate insertion part 16).

In some implementations, the antenna on the PCB 12 is a dipole antenna which has two arms with an end gap formed between the ends of the arms (not shown in FIGS. 1A-C and 2A-C).

In some implementations, the antenna PCB 12 is made of polyimide and copper layers and gold plating.

In the examples illustrated in FIGS. 1A-C and 2A-C, the antenna PCB 12 and the faceplate insertion part 16 are inserted into the faceplate base part 14 from the medial side of the faceplate 10 (which is the side of the faceplate 10 which faces the tympanic membrane when the hearing device is worn at least partially in the ear canal). As can be seen in FIGS. 1A, 1B and 2A, 2B, in a first assembly step the antenna PCB 12 is inserted into the faceplate base part 14 in such a manner that the antenna PCB 12 extends along the inner surface 18.

In a second assembly step (see FIGS. 1C and 2C), the faceplate insertion part 16 is inserted into the faceplate base part 14 in such a manner that the outer surface 20 pushes the antenna PCB 12 against the first surface 18 of the faceplate base part 14. Thereby the inner surface 18 and the outer surface 20 define a trench for the antenna PCB 12, with the inner surface 18 and the outer surface 20 acting as the two walls of the trench.

In a third assembly step, the faceplate insertion part 16 is fixed within the faceplate base part 14 so as to form the faceplate 10.

In the example of FIGS. 1A to 1C, the faceplate insertion part 16 comprises engagement structures 36 for holding down the antenna PCB 12 towards the faceplate base part 14 when the faceplate insertion part 16 has been inserted into the faceplate base part 14. In the example shown in FIGS. 1A to 1C, the engagement structures 36 comprise a plurality of tabs 38 which extend outwardly in a direction essentially perpendicular to the second surface 20, with the tabs 38 being circumferentially spaced apart.

The inner surface 18 of the faceplate base part 14 and the outer surface 20 of the faceplate insertion part 16 may be inclined in parallel directions so that the outer surface 20 presses the antenna PCB 12 snugly towards the inner surface 18.

The engagement structures 36 allow for fixation of the antenna PCB 12 in the medial-lateral direction 28 without a need for use of an adhesive, etc. This allows for an option to remove the antenna PCB 12 from the faceplate 10, for example, for replacement.

In the examples illustrated in FIGS. 1A-C and 2A-C, the faceplate insertion part 16 may be fixed to the faceplate base part 14 by an adhesive. To this end, adhesive is applied to the faceplate base part and/or the faceplate insertion part 16 prior to inserting the faceplate insertion part 16 into the faceplate base part 14.

In the example of FIGS. 2A to 2C the faceplate base part 14 and the faceplate insertion part 16 comprise mating features 40 and 42 for aligning the faceplate base part 14 and the faceplate insertion part 16 relative to each other. In the illustrated example, the mating features are implemented as grooves 40 and complementary projections 42.

An adhesive may be applied at least part of the mating features 40, 42 so as to fix the faceplate insertion part 16 to the faceplate base part 14.

In the illustrated example, the faceplate insertion part 16 is not provided with the engagement structures 36 of the example of FIGS. 1A to 1C. Accordingly, the antenna PCB 12 may be fixed to the faceplate 10 to the applying an adhesive to the antenna PCB 12 so as to fix the PCB of the antenna PCB 12 between the outer surface 20 of the faceplate insertion part 16 and the inner surface 18 of the faceplate base part 14.

It is noted that in the first assembly step in both examples elastic forces in antenna PCB 12 resulting from the bending of the antenna PCB 12 push the antenna PCB 12 against the inner surface 18 of the faceplate base part 14, so that the faceplate insertion part 14 can be easily inserted into the faceplate base part 14 without a need to first fix the antenna PCB 12 to the inner surface 18.

According to a second aspect of the invention, a faceplate base part comprising a trench defined by a first surface and a second surface and a plastic frame are provided. The antenna PCB is inserted into the trench of the faceplate base part so that that the antenna PCB extends along the first surface and the antenna PCB is fixed to the faceplate base part. The plastic frame is inserted into the trench, together with the antenna PCB or after the antenna PCB has been inserted into the trench, so as to press the PCB against the first surface along at least part of its length, with the plastic frame abutting the second surface. The first and second surfaces form the walls of the trench, one representing an inner wall and the other representing an outer wall.

Three different examples of such assembly method are illustrated in FIGS. 3A-C, FIGS. 4A-D and FIGS. 5A-C, wherein the trench for receiving the antenna PCB 12 is not formed by cooperation of two separate parts of the faceplate as in the previously discussed examples, but rather the trench is already provided initially in the faceplate base part 114, so that no baseplate insertion part is required to form the trench. In other words, the faceplate base part comprises a trench 150 which is defined by a first surface (or wall) 118 and a second surface (or wall) 120. The baseplate insertion part is replaced by a plastic frame which serves to press the antenna PCB against the first surface 118 along at least part of its length, with the plastic frame abutting the second surface 120.

Figure 3A:
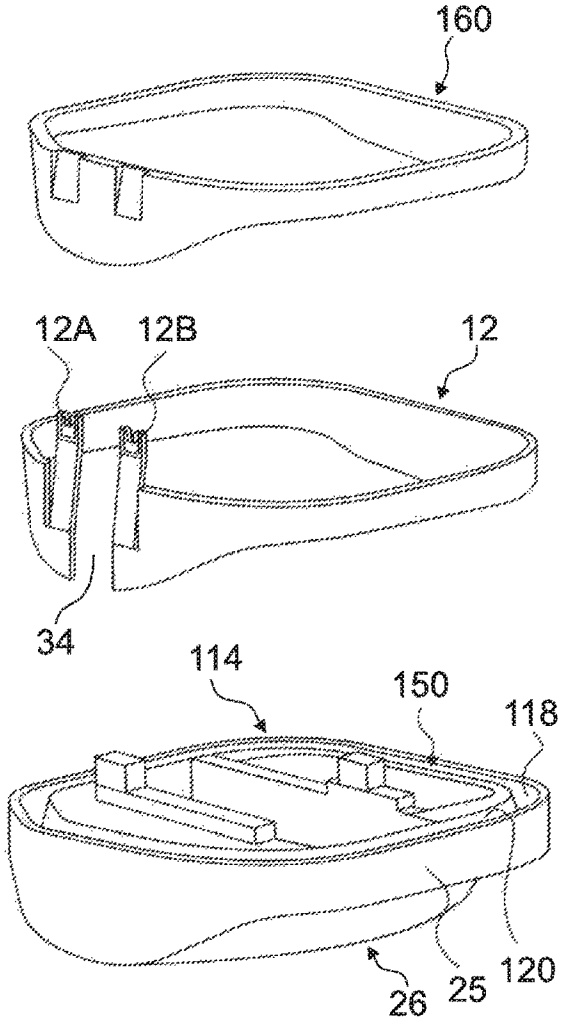
FIGS. 3A to 3C are views similar to FIGS. 1A to 1C, wherein a third example is shown.
Figure 3B:
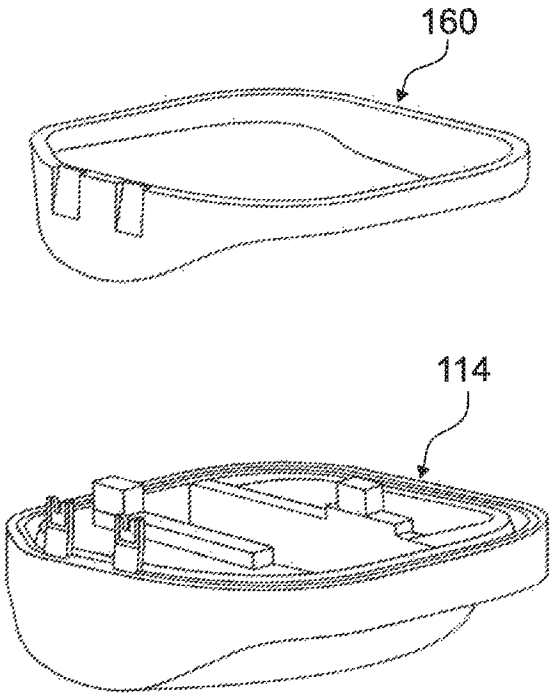
Figure 3C:
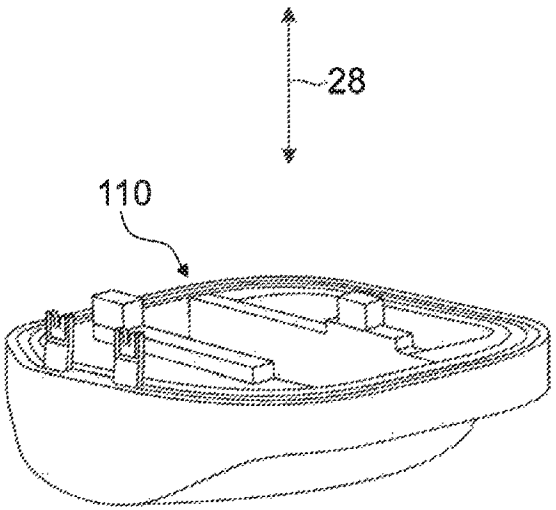
Figure 4A:
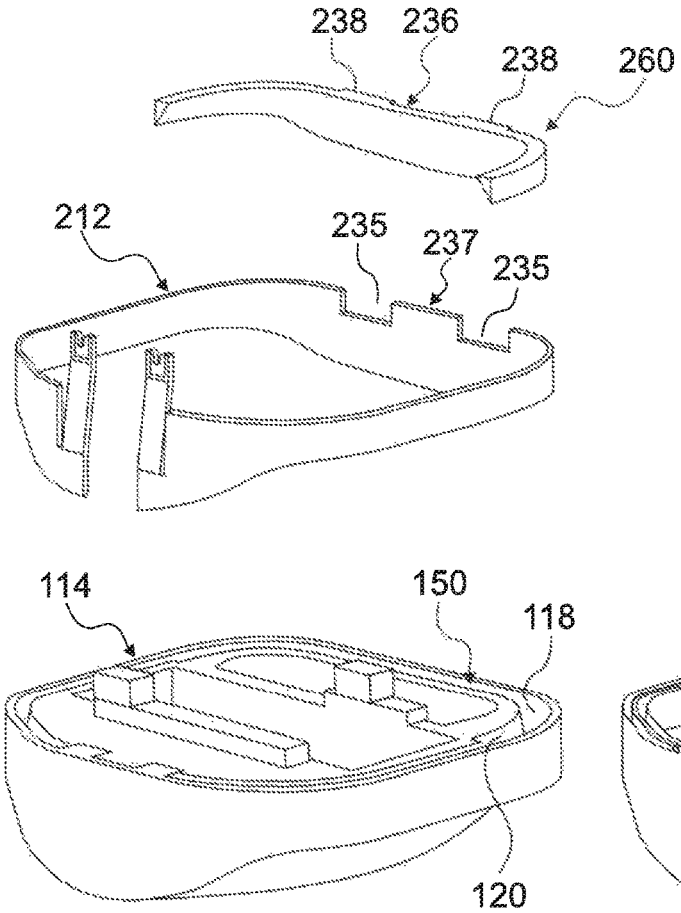
FIGS. 4A to 4C are views similar to FIGS. 1A to 1C, wherein a fourth example is shown.
Figure 4B:
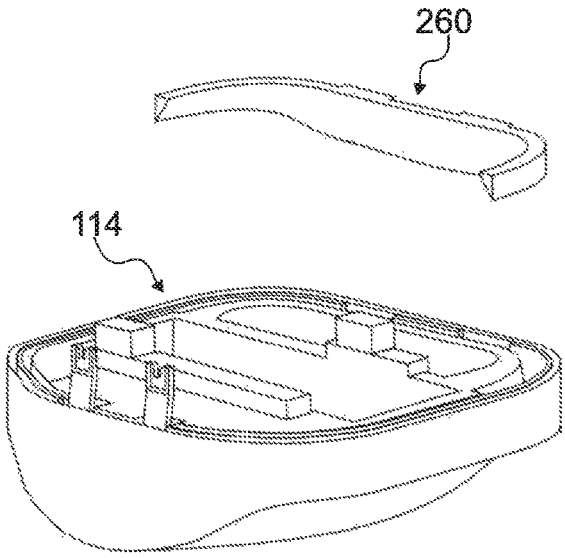
Figure 4C:
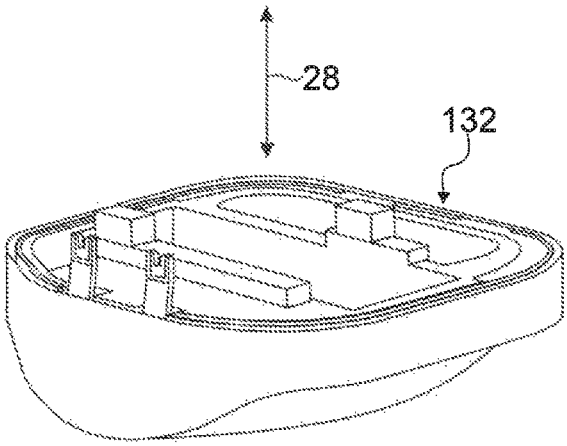
Figure 4D:
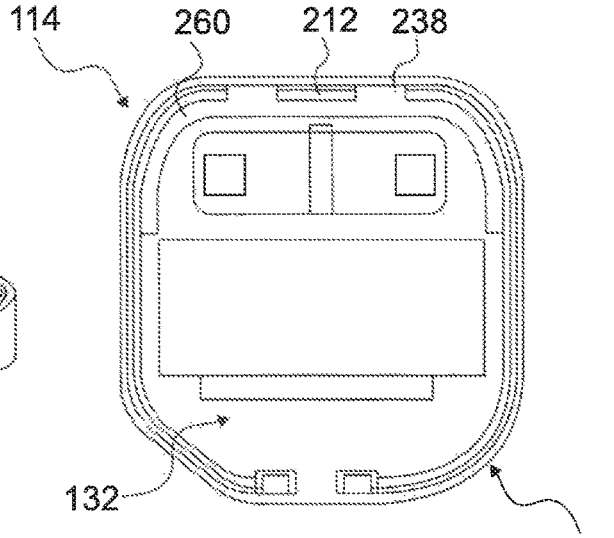
FIG. 4D shows an elevated view of the assembled faceplate.
Figure 5A:
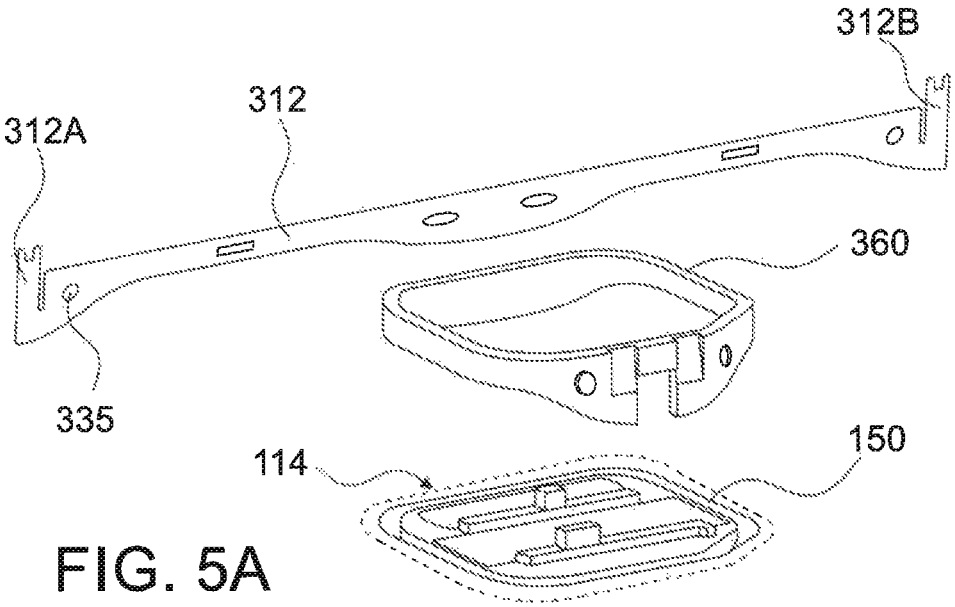
FIGS. 5A to 5C are perspective views of a fifth example of a faceplate during different intermediate assembly stages.
Figure 5B:
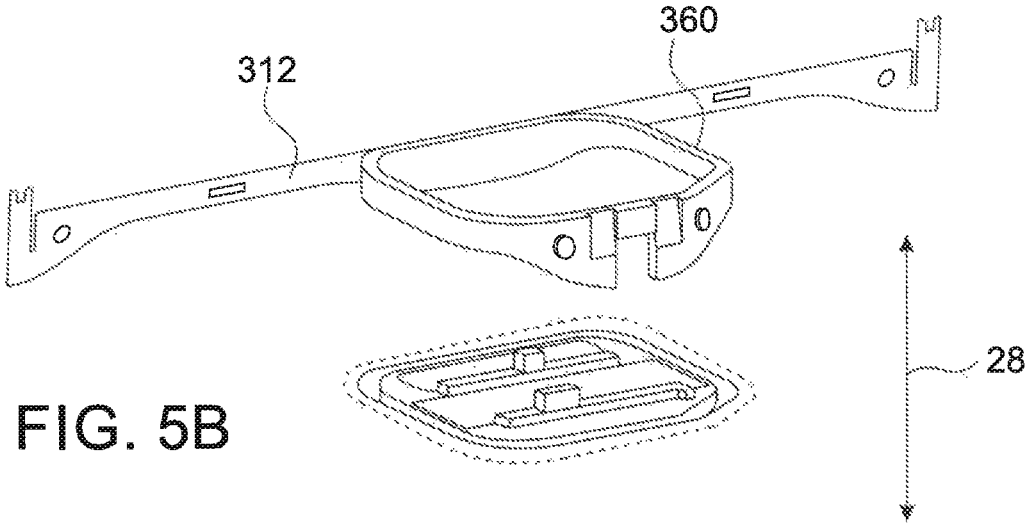
Figure 5C:
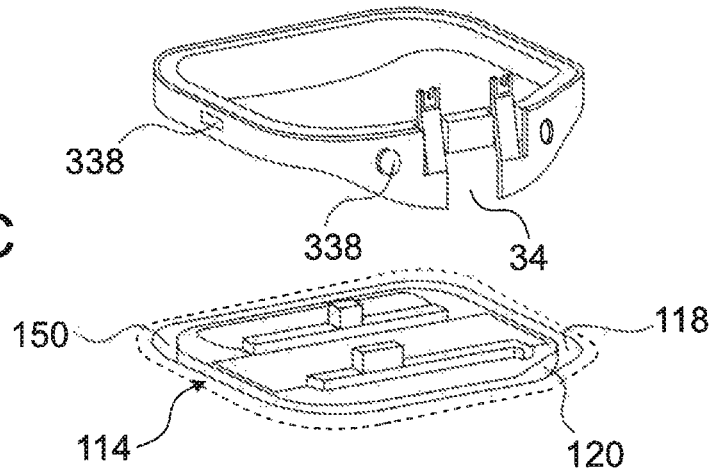

In the examples of FIGS. 3A-C and 4A-D, the antenna PCB 12 is first inserted into the trench 150 and thereafter the plastic frame is inserted into the trench; according to the example illustrated in FIGS. 5A-C, the antenna PCB 12 is first fixed to the plastic frame and then the antenna PCB and the plastic frame are together inserted into the trench. In all cases, the antenna PCB is finally fixed to the faceplate base part within the trench.

In the example illustrated in FIGS. 3A to 3C the plastic frame 160 extends along more than half of the length of the PCB of the antenna PCB 12, and, as illustrated in FIGS. 3A to 3C it may extend along the entire length of the antenna PCB 12. The plastic frame 160 may also extend in the region 34 between the two antenna feedpoints 12A, 12B of the antenna PCB 12 so as to form a closed frame. The contour of the plastic frame 160 may be substantially equal to contour of the antenna PCB 12 so as to provide for full support for the antenna PCB 12.

In the example of FIGS. 3A to 3C the antenna 12 is inserted into the trench 150 as a first assembly step and then is fixed by an adhesive to the first surface 118 (which forms the inwardly facing wall of the trench 150), see FIGS. 3A and 3B. In a second assembly step, the plastic frame 160 is inserted into the trench 150 at a position inwardly with regard to the antenna PCB 12 and then is fixed by an adhesive to the antenna PCB 12 and to the second surface 120 (which forms the outwardly facing wall of the trench 150), see FIGS. 3B and 3C.

The main difference of the example shown in FIGS. 4A to 4D to the previous example is that the plastic frame 260 extends along less than half of the length of the antenna PCB 212 and that the plastic frame 260 comprises engagement structures 236 configured to engage with mating structures 237 of the antenna PCB 212 so as to hold down and locate the antenna PCB 212 within the trench 150 of the faceplate base part 114. In the example of FIGS. 4A to 4C the engagement structures 236 of the plastic frame 260 comprises a plurality of tabs 238, and the antenna PCB 212 comprises mating cutouts 235.

As in the example of FIGS. 3A-3C, the antenna PCB 212 is first inserted into the trench 150 and is fixed by an adhesive, and then the plastic frame 260 is inserted into the trench and is fixed by the adhesive to the antenna PCB 212 and the second surface 120. An elevated view of the medial side 132 of the faceplate 110 after assembly is shown in FIG. 4D.

Preferably, the plastic frame 260 is present only in regions of the antenna PCB 212 where the impact of RF performance is expected to be critical.

The main difference of the example illustrated in FIGS. 5A to 5C with regard to the example illustrated in FIGS. 3A to 3C is that the antenna PCB 312 is first fixed to the plastic frame 360 prior to inserting the plastic frame 360 and the antenna PCB 312 into the trench 150 of the faceplate base part 114. The antenna PCB 312 and the plastic frame 360 comprise mating alignment features for aligning the antenna PCB 312 to the plastic frame 360. In addition, the alignment features of the plastic frame 360 may serve to fix the antenna PCB 312 to the plastic frame 360. Alternatively or in addition, the antenna PCB 312 may be fixed to the plastic frame 360 by an adhesive. As in the example of FIGS. 3A to 3C, the plastic frame 360 stands along the entire length of the antenna PCB 312 and also extends across the region 34 between the antenna feed points 312A, 312B. In the example illustrated in FIGS. 5A to 5C, the alignment structures comprise cutouts/openings 335 in the antenna PCB 312 and mating projections 338 at the plastic frame 360.

The plastic frame 360, together with the antenna PCB 312 fixed to the plastic frame 360, is finally fixed within the trench 150 by an adhesive.

As in the example of FIGS. 3A to 3C the contour of the plastic frame 360 substantially equals to the contour of the antenna PCB 312.

The invention claimed is:

1. A method of manufacturing a faceplate for a hearing device, the faceplate configured to cover a lateral opening of a housing of the hearing device and having a side which is laterally oriented when the hearing device is worn at least partially in the ear canal, comprising the steps of:

providing a faceplate base part comprising a first surface, a faceplate insertion part comprising a second surface, and a printed circuit board ("PCB") with an antenna;

inserting the antenna PCB into the faceplate base part so that that the antenna PCB extends along the first surface;

inserting the faceplate insertion part into the faceplate base part, together with the antenna PCB or after the antenna PCB has been inserted into the faceplate base part, so that the second surface of the faceplate insertion part pushes the antenna PCB against the first surface of the faceplate base part; and fixing the faceplate insertion part within the faceplate base part so as to form the faceplate.

2. The method of claim 1, wherein the faceplate insertion part comprises engagement structures for holding down the antenna PCB towards the faceplate base part.

3. The method of claim 2, wherein the engagement structures of the faceplate insertion part comprise a plurality of tabs which extend towards the exterior of the hearing device in a direction perpendicular to second surface and which are circumferentially spaced apart.

4. The method of claim 1, wherein the faceplate base part and the faceplate insertion part comprise mating features so as to align the faceplate base part and the faceplate insertion part relative to each other.

5. The method of claim 1, wherein the first surface and the second surface are complementary, and wherein the first surface extends along at least part of a circumference of the faceplate base part, and wherein the second surface extends along at least part of a circumference of the faceplate insertion part.

6. The method of claim 1, wherein the first surface of the faceplate base part faces the interior of the hearing device and the second surface of the faceplate insertion part faces the exterior of the hearing device, so as to form a trench for receiving the antenna PCB, and wherein the first surface and the second surface are substantially orthogonal to the laterally oriented side of the faceplate.

7. The method of claim 1, wherein the antenna PCB is flexible.

8. The method of claim 1, wherein the antenna PCB is oriented orthogonal to the laterally oriented side of the faceplate, and wherein the antenna PCB is folded around a battery and an electronics subassembly of the hearing device.

9. The method of claim 1, wherein the antenna is a dipole antenna which has two arms with an end gap between the ends of the arms.

10. A method of manufacturing a faceplate for a hearing device, the faceplate configured to cover a lateral opening of a housing of the hearing device and having a side which is laterally oriented when the hearing device is worn at least partially in the ear canal, comprising the steps of:

providing a faceplate base part comprising a trench defined by a first surface and a second surface, a plastic frame and a PCB with an antenna;

inserting the antenna PCB into the trench of the faceplate base part so that the antenna PCB extends along the first wall; and fixing the antenna PCB to the faceplate base part;

wherein the plastic frame is inserted into the trench, together with the antenna PCB or after the antenna PCB has been inserted into the trench, so as to press the PCB against the first surface along at least part of its length, with the plastic frame abutting the second surface.

11. The method of claim 10, wherein the plastic frame extends along more than half of the length of the antenna PCB and wherein a contour of the plastic frame substantially equals a contour of the antenna PCB.

12. The method of claim 10, wherein the antenna PCB first is inserted into the trench and then the plastic frame is inserted into the trench.

13. The method of claim 10, wherein the antenna PCB is first fixed to the plastic frame and then the plastic frame, together with the antenna PCB, is inserted into the trench.

14. The method of claim 13, wherein the antenna PCB is wrapped around the plastic frame for fixing the antenna PCB to the plastic frame, wherein the antenna PCB and the plastic frame comprise alignment features for aligning the antenna PCB to the plastic frame, and wherein the alignment features of the plastic frame are configured to fix the antenna PCB to the plastic frame.

15. The method of claim 10, wherein the plastic frame extends along less than half of the length of the antenna PCB, wherein the plastic frame comprises engagement structures configured to engage with mating engagement structures of the antenna PCB to hold down and locate the antenna PCB within the trench.

16. The method of claim 10, wherein the first surface of the faceplate base part faces the interior of the hearing device and the second surface of the faceplate base part faces the exterior of the hearing device, and wherein the first surface and the second surface are substantially orthogonal to the laterally oriented side of the faceplate.

17. The method of claim 10, wherein the antenna PCB is flexible.

18. The method of claim 10, wherein the antenna PCB is oriented orthogonal to the laterally oriented side of the faceplate, and wherein the antenna PCB is folded around a battery and an electronics subassembly of the hearing device.

19. The method of claim 10, wherein the antenna is a dipole antenna which has two arms with an end gap between the ends of the arms.

20. The method of claim 10, wherein the plastic frame extends along the entire length of the flexible antenna PCB and a contour of the plastic frame substantially equals a contour of the antenna PCB.

* * * * *